US006896228B1

(12) United States Patent
Lu

(10) Patent No.: US 6,896,228 B1
(45) Date of Patent: May 24, 2005

(54) FIXING DEVICE FOR A BATH SUPPORT RACK

(76) Inventor: Tung Hsien Lu, No. 289, Peng Yi Rd., Tai Ping City, Taichung (TW) 411

( * ) Notice: Subject to any disclaimer, the term of this patent is extended or adjusted under 35 U.S.C. 154(b) by 0 days.

(21) Appl. No.: 10/421,747

(22) Filed: Apr. 24, 2003

(51) Int. Cl.[7] ..... A47G 1/17
(52) U.S. Cl. ..... 248/205.8; 248/206.2; 248/537; 211/105.1
(58) Field of Search ..... 248/205.5, 251, 248/205.6, 205.7, 205.8, 205.9, 206.1, 206.2, 248/363, 683, 537, 304.3, 362, 467; 211/105.1, 211/105.2, 16, 87, 123, 7; 4/601, 605

(56) References Cited

U.S. PATENT DOCUMENTS 3,020,017 A * 2/1962 Watson ..... 248/205.8
3,180,604 A * 4/1965 Hammer ..... 248/205.8
3,878,573 A * 4/1975 Boudewyn ..... 5/658
4,043,531 A * 8/1977 Green ..... 248/537
6,402,104 B1 * 6/2002 Smith ..... 248/205.5

FOREIGN PATENT DOCUMENTS

JP 11047030 * 2/1999
JP 11290585 * 10/1999
JP 2001214484 * 8/2001
JP 2001220783 * 8/2001

* cited by examiner

*Primary Examiner*—Gwendolyn Baxter
(74) *Attorney, Agent, or Firm*—Charles E. Baxley

(57) ABSTRACT

A fixing device for a bath support rack includes a base, a body mounted on the base, a clamping rod mounted on the body, and a press mechanism movably mounted on the body and having a distal end rested on a central portion of the base, so that the press mechanism can be pressed downward to compress the base. Thus, the fixing device can be positioned on an object, such as a flat wall, rigidly and stably. In addition, the fixing device can be detached from the object easily and conveniently.

11 Claims, 6 Drawing Sheets

FIXING DEVICE FOR A BATH SUPPORT RACK

BACKGROUND OF THE INVENTION

1. Field of the Invention

The present invention relates to a fixing device, and more particularly to a fixing device for a bath support rack.

2. Description of the Related Art

A conventional fixing device comprises a body, and a sucker mounted on the body. In practice, the sucker can be attached on an object, such as the vertical wall in the bathroom or kitchen, so that the fixing device can be fixed on the vertical wall. However, the air between the sucker and the vertical wall is not compressed outward completely, thereby reducing the attaching action of the sucker, so that the sucker is easily detached from the wall during a period of time, thereby causing inconvenience to the user.

SUMMARY OF THE INVENTION

The primary objective of the present invention is to provide a fixing device for a bath support rack, wherein the fixing device can be positioned on an object, such as a flat wall, rigidly and stably.

Another objective of the present invention is to provide a fixing device for a bath support rack, wherein the fixing device can be detached from the object easily and conveniently.

A further objective of the present invention is to provide a fixing device for a bath support rack, wherein the body can be rotated on the base freely and can also be positioned on the base rigidly and stably, so that the angle of the clamping opening of the clamping rod can be adjusted arbitrarily, so as to fit the practical working requirement.

In accordance with the present invention, there is provided a fixing device, comprising:

a base;

a body mounted on the base;

a clamping rod mounted on the body; and a press mechanism movably mounted on the body and having a distal end rested on a central portion of the base, so that the press mechanism can be pressed downward to compress the base.

Further benefits and advantages of the present invention will become apparent after a careful reading of the detailed description with appropriate reference to the accompanying drawings.

DETAILED DESCRIPTION OF THE INVENTION

Figure 1:
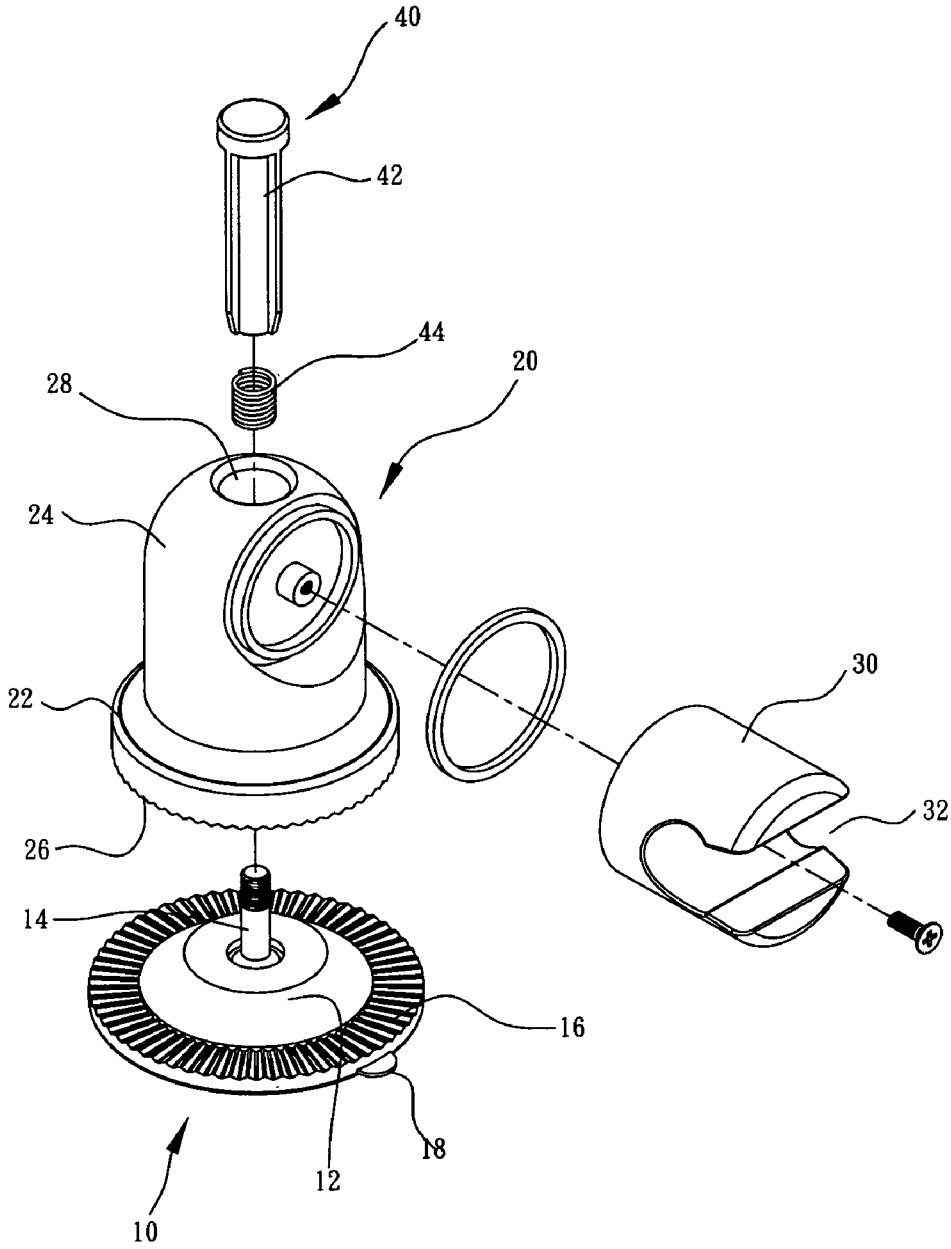
FIG. 1 is an exploded perspective view of a fixing device for a bath support rack in accordance with the preferred embodiment of the present invention.
Figure 2:
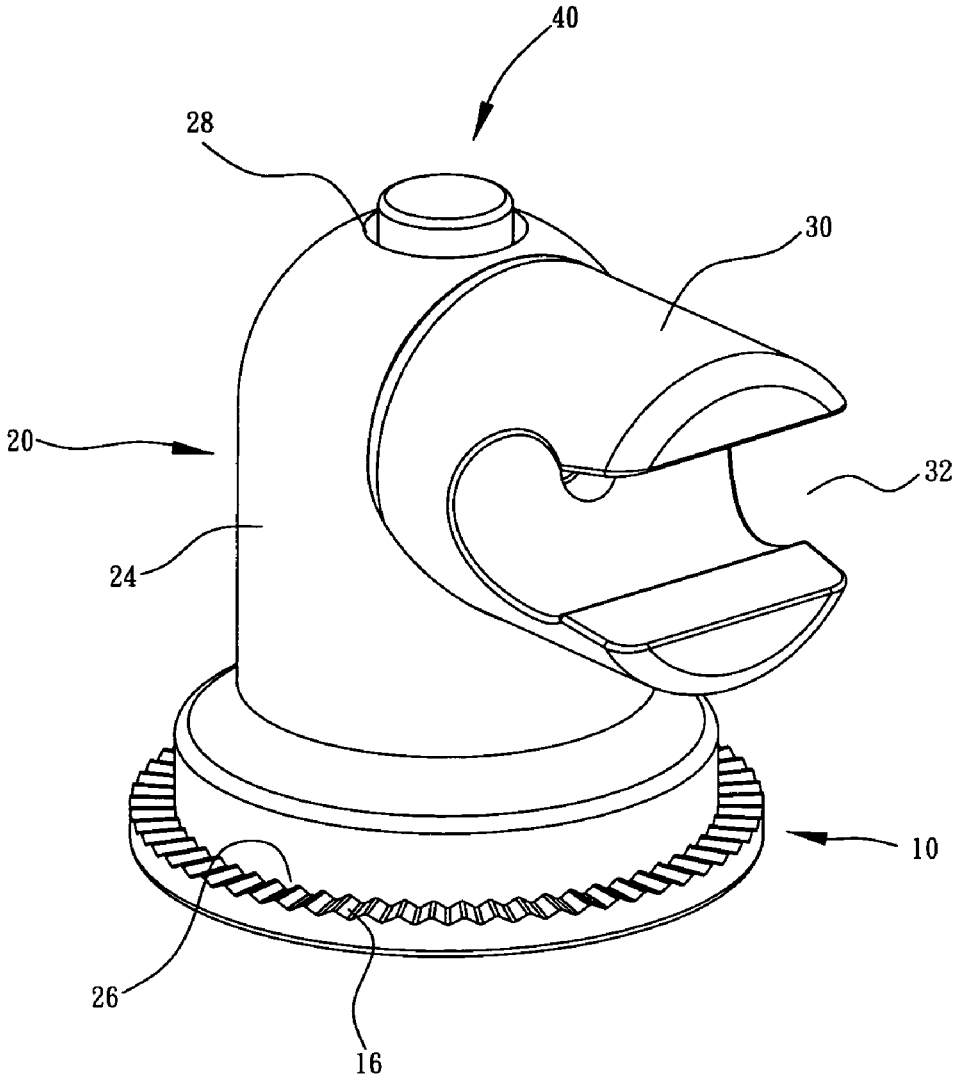
FIG. 2 is a perspective view of the fixing device for a bath support rack in accordance with the preferred embodiment of the present invention.
Figure 3:
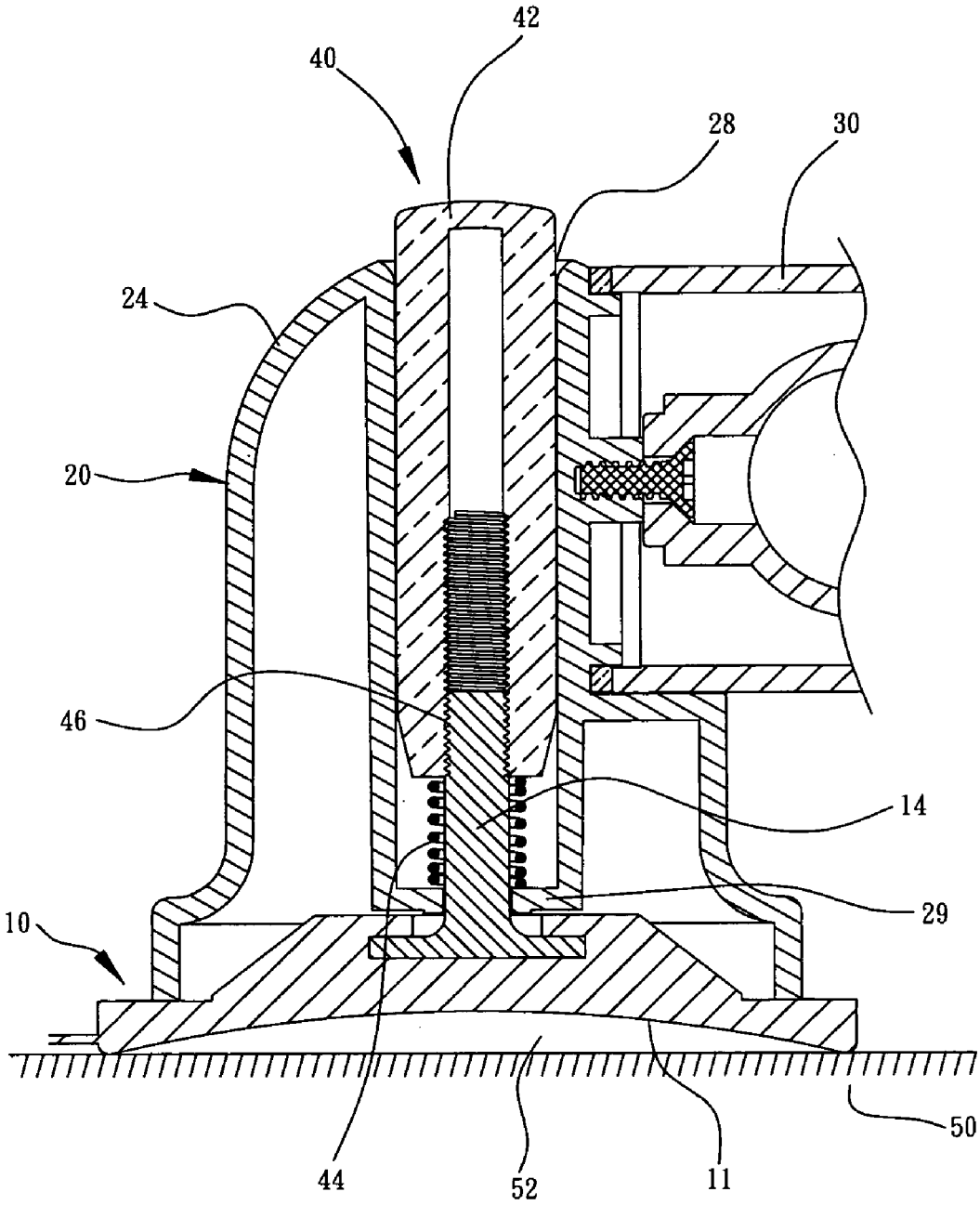
FIG. 3 is a partially cut-away side plan cross-sectional view of the fixing device for a bath support rack as shown in FIG. 2.

Referring to the drawings and initially to FIGS. 1–3, a fixing device for a bath support rack in accordance with the preferred embodiment of the present invention comprises a base 10, a body 20, a clamping rod 30, and a press mechanism 40.

The base 10 is a sucker. The base 10 has a top having a central portion formed with a lug 12 which is provided with a threaded rod 14. The threaded rod 14 is vertical to a surface of the base 10. The top of the base 10 has a periphery formed with a plurality of ratchet teeth 16. The base 10 has a side formed with a protruding pull ear 18. The base 10 has a bottom having a central portion formed with a concave surface 11.

The body 20 is rotatably mounted on the base 10 and includes a circular bottom portion 22 and a cylindrical seat portion 24 formed on a top of the bottom portion 22. The bottom portion 22 of the body 20 has a bottom formed with a plurality of engaging teeth 26 meshing with the ratchet teeth 16 of the base 10. The seat portion 24 of the body 20 has an inside formed with a mounting recess 28. The mounting recess 28 of the seat portion 24 of the body 20 has a bottom formed with a catch face 29.

The clamping rod 30 is mounted on a side of the seat portion 24 of the body 20 and has an end formed with a clamping opening 32.

The press mechanism 40 is mounted on the body 20 and includes a press rod 42 movably mounted in the mounting recess 28 of the seat portion 24 of the body 20, and a spring 44 mounted on the threaded rod 14 of the base 10 and urged between a bottom of the press rod 42 and the catch face 29 of the mounting recess 28 of the seat portion 24 of the body 20. The press rod 42 of the press mechanism 40 has a hollow inside having an inner wall formed with an inner thread 46 screwed on the threaded rod 14 of the base 10.

In assembly, the body 20 is mounted on the base 10, so that the engaging teeth 26 of the bottom portion 22 of the body 20 mesh with the ratchet teeth 16 of the base 10. At this time, the threaded rod 14 of the base 10 is extended through the catch face 29 into the mounting recess 28 of the seat portion 24 of the body 20. Then, the spring 44 of the press mechanism 40 is placed into the mounting recess 28 of the seat portion 24 of the body 20 and mounted on the threaded rod 14 of the base 10. Then, the press rod 42 of press mechanism 40 is placed into the mounting recess 28 of the seat portion 24 of the body 20 and is screwed on the threaded rod 14 of the base 10, so that the spring 44 of the press mechanism 40 is urged between the bottom of the press rod 42 and the catch face 29 of the body 20. Then, the clamping rod 30 is locked on the seat portion 24 of the body 20 with the clamping opening 32 facing outward, thereby assembling the fixing device for a bath support rack.

Referring to FIG. 3 with reference to FIGS. 1 and 2, the base 10 is mounted on a flat wall 50, thereby forming an air chamber 52 between the concave surface 11 of the base 10 and the flat wall 50. The user can push the seat portion 24 of the body 20 to press and move the base 10 toward the flat wall 50 to compress the partial air in the air chamber 52 outward, so that the base 10 is attached on the flat wall 50.

Figure 4:
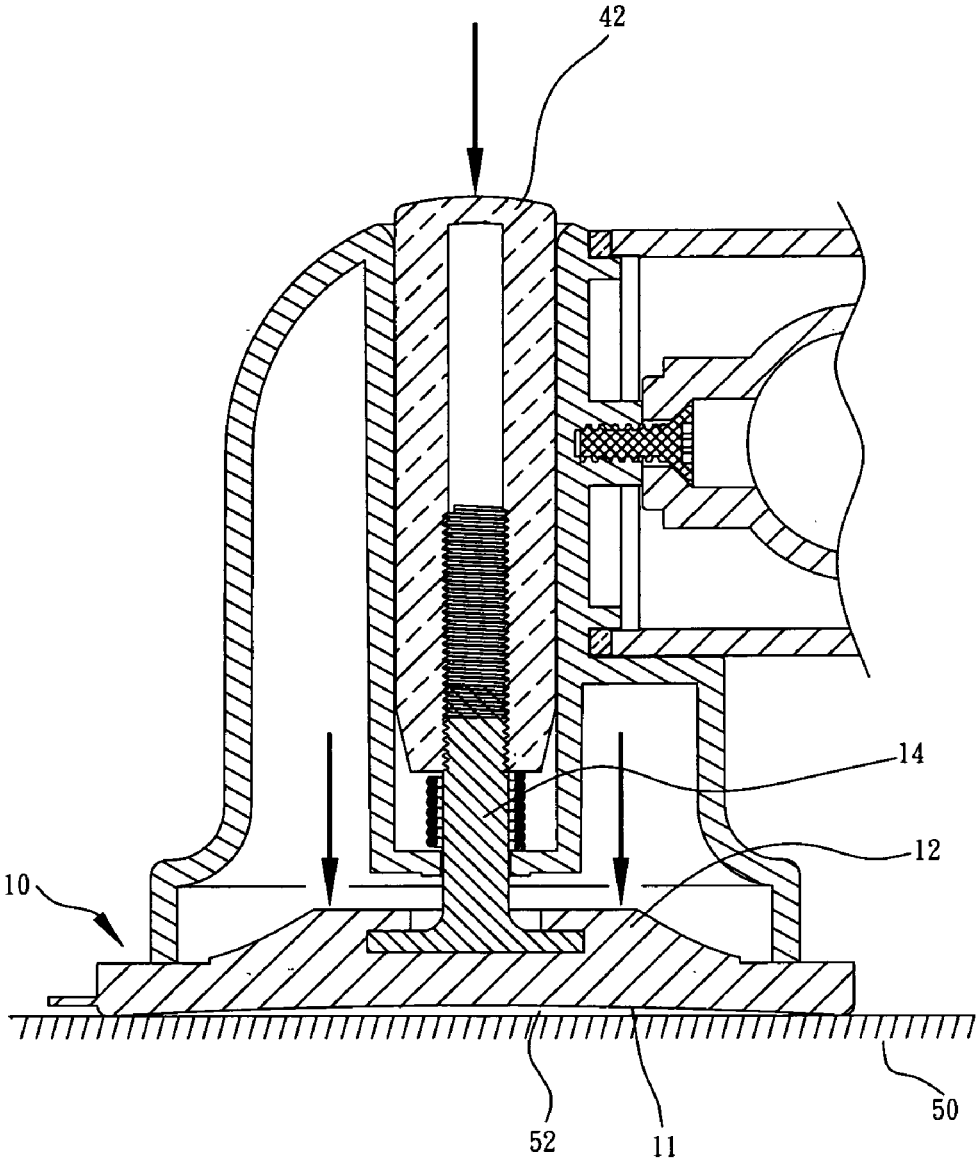
FIG. 4 is a schematic operational view of the fixing device for a bath support rack as shown in FIG. 3 in use.

Referring to FIG. 4 with reference to FIGS. 1 and 2, the user can press the press rod 42 of the press mechanism 40 to move the threaded rod 14 of the base 10 downward to press and move the concave surface 11 of the base 10 toward the flat wall 50 so as to further compress most of the air in the air chamber 52 outward. Thus, the air pressure in the air chamber 52 is much smaller than that of the ambient environment, so that the base 10 is positioned on the flat wall 50 rigidly and stably.

In detachment, the user can pull the pull ear 18 of the base 10 upward, so that the air in the ambient environment can enter the air chamber 52, thereby greatly reducing the pressure drop between the air chamber 52 and the ambient environment. At this time, the press rod 42 of the press mechanism 40 can be returned to the original position by the restoring force of the spring 44 of the press mechanism 40, so that the base 10 can be detached from the flat wall 50 easily and conveniently.

Figure 5A:
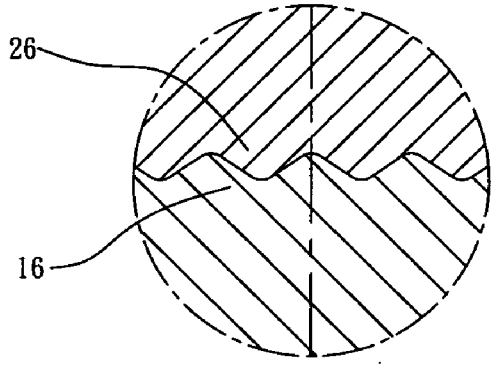
FIG. 5A is a partially enlarged view of the fixing device for a bath support rack as shown in FIG. 5.
Figure 5:
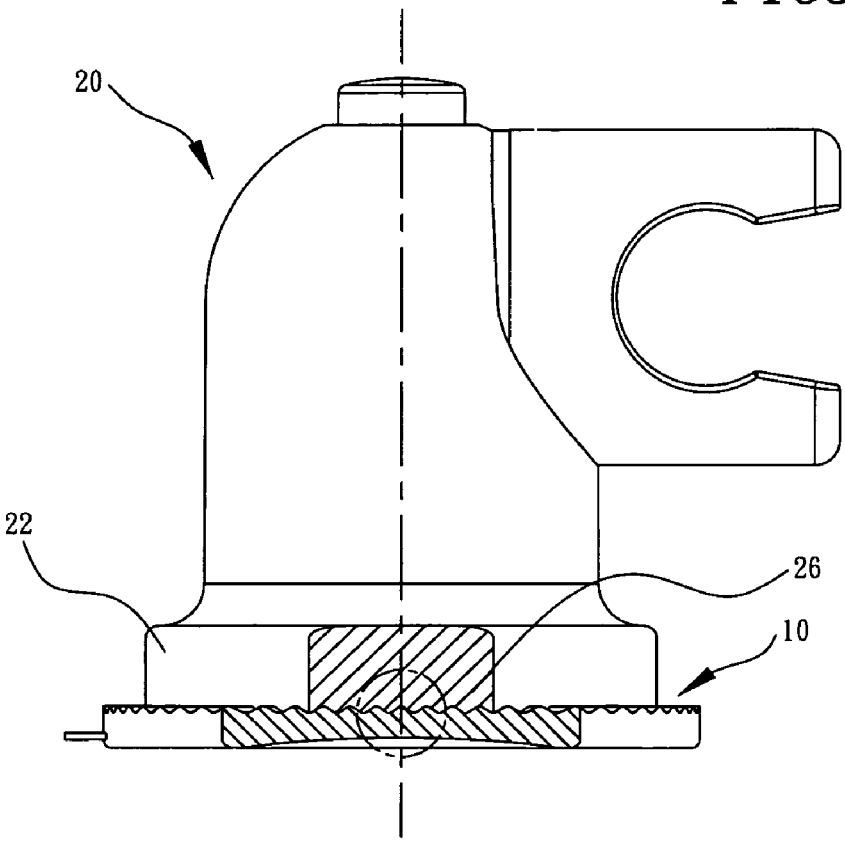
FIG. 5 is a side plan partially cross-sectional view of the fixing device for a bath support rack as shown in FIG. 2.

Referring to FIGS. 5 and 5A, the engaging teeth 26 of the bottom portion 22 of the body 20 mesh with the ratchet teeth 16 of the base 10. Thus, after the body 20 is rotated on the base 10 to a determined position, the engaging teeth 26 of the bottom portion 22 of the body 20 mesh with the ratchet teeth 16 of the base 10, so that the body 20 is positioned on the base 10.

Figure 6:
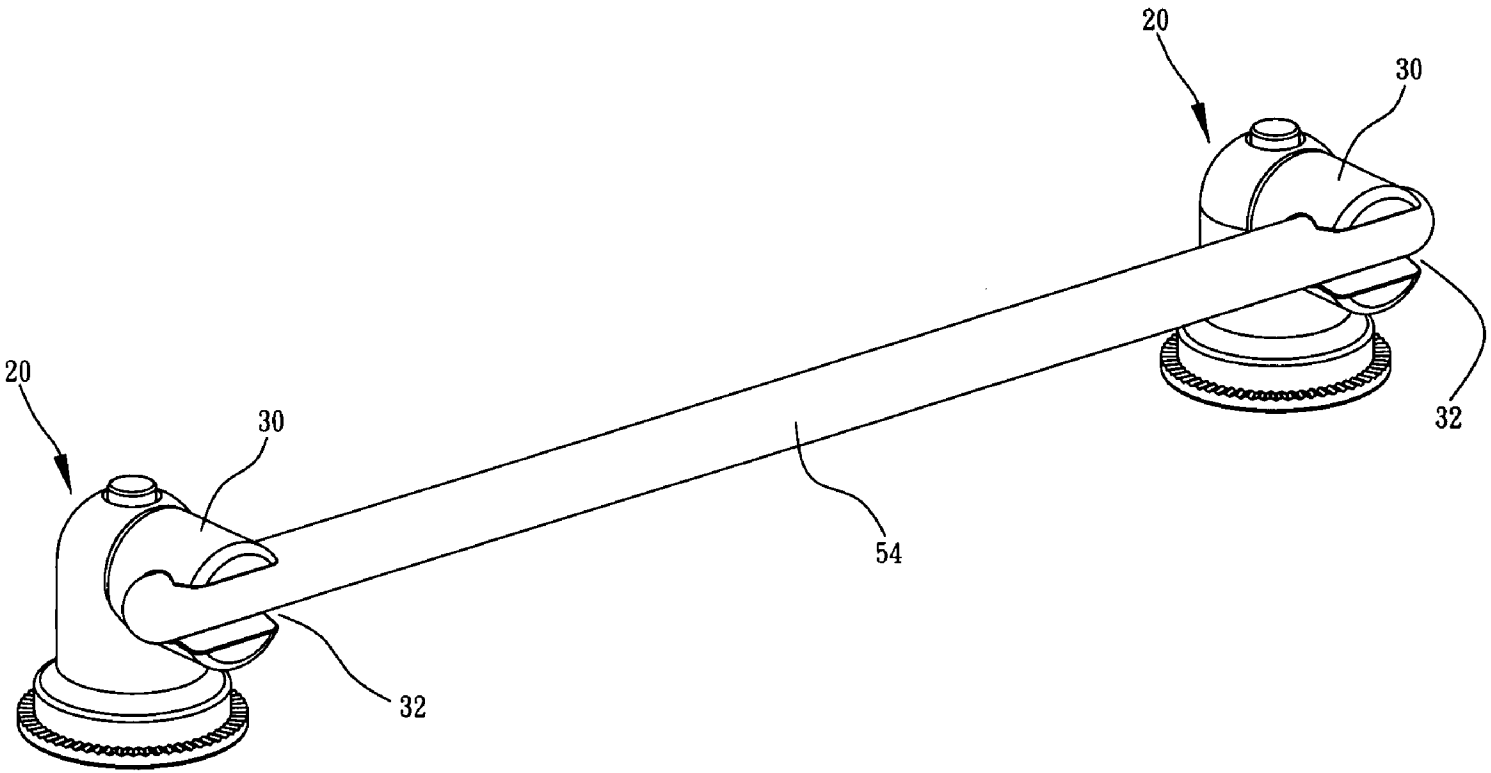
FIG. 6 is a perspective view showing the practical usage of the fixing device for a bath support rack in accordance with the preferred embodiment of the present invention.

Referring to FIG. 6 with reference to FIGS. 1 and 2, a hanging rod 54 is mounted between two fixing devices, with each of the two ends of the hanging rod 54 being clamped in the clamping opening 32 of the clamping rod 30 of the respective fixing device.

Accordingly, the fixing device in accordance with the present invention has the following advantages.

1. The user can press the press rod 42 of the press mechanism 40 to press and move the concave surface 11 of the base 10 toward the flat wall 50 so as to further compress most of the air in the air chamber 52 outward, so that the base 10 is positioned on the flat wall 50 rigidly and stably.

2. The user only needs to press the press rod 42 of the press mechanism 40 so as to position the base 10 on the flat wall 50 in place, thereby facilitating operation of the fixing device.

3. The body 20 can be rotated on the base 10 freely and can also be positioned on the base 10 rigidly and stably, so that the angle of the clamping opening 32 of the clamping rod 30 can be adjusted arbitrarily, so as to fit the practical working requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A fixing device, comprising:

a base;

a body mounted on the base;

a clamping rod mounted on a side of the body, the clamping rod having an end formed with a clamping opening having an open side;

a press mechanism movably mounted on the body and having a distal end rested on a central portion of the base, the press mechanism being downwardly pressable to compress the base, the base having a top formed with a threaded rod secured on the distal end of the press mechanism, the press mechanism including a press rod movably mounted on the body and secured on the threaded rod of the base, the press rod of the press mechanism having a hollow inside with an inner wall formed with an internal thread threadedly engaged with the threaded rod of the base; and, a spring mounted on the threaded rod of the base and urged between an end of the press rod and a bottom of the body.

2. The fixing device in accordance with claim 1, wherein the base is a sucker.

3. The fixing device in accordance with claim 1, wherein the threaded rod is vertical to a surface of the base.

4. The fixing device in accordance with claim 1, wherein the central portion of the base is formed with a lug which is provided with the threaded rod.

5. The fixing device in accordance with claim 1, wherein the body includes a seat portion having an inside formed with a mounting recess for receiving the press rod of the press mechanism.

6. The fixing device in accordance with claim 5, wherein the mounting recess of the seat portion of the body has a bottom formed with a catch face rested on the spring of the press mechanism.

7. The fixing device in accordance with claim 1, wherein the threaded rod of the base is extended through a bottom of the body.

8. The fixing device in accordance with claim 1, wherein the body is rotatably mounted on the base.

9. The fixing device in accordance with claim 1, wherein the base has a top having a periphery formed with a plurality of ratchet teeth, and the body includes a bottom portion having a bottom formed with a plurality of engaging teeth meshing with the ratchet teeth of the base.

10. The fixing device in accordance with claim 1, wherein the base has a side formed with a protruding pull ear.

11. The fixing device in accordance with claim 1, wherein the base has a bottom having a central portion formed with an arcuate concave surface.

* * * * *